US008403174B2

(12) United States Patent
Blake et al.

(10) Patent No.: US 8,403,174 B2
(45) Date of Patent: Mar. 26, 2013

(54) SNAP RESEALING CLOSURE FOR A CONTAINER

(75) Inventors: John Blake, Danbury, CT (US); Jiayan Gu, Wappingers Falls, NY (US); Glenn Gruskin, Nanuet, NY (US); Robert A. Ziegler, New Brunskwick, NJ (US); E. Joel Carpenter, Point Pleasant, PA (US)

(73) Assignee: Kraft Foods Global Brands LLC, Northfield, IL (US)

( * ) Notice: Subject to any disclaimer, the term of this patent is extended or adjusted under 35 U.S.C. 154(b) by 667 days.

(21) Appl. No.: 11/510,717

(22) Filed: Aug. 28, 2006

(65) Prior Publication Data

US 2008/0047965 A1 Feb. 28, 2008

(51) Int. Cl.
*B65D 41/16* (2006.01)

(52) U.S. Cl. ..... 220/780; 215/320

(58) Field of Classification Search ..... 220/634, 220/780, 281, 203.09, 796; 215/296, 301, 215/317, 320

See application file for complete search history.

(56) References Cited

U.S. PATENT DOCUMENTS

| | | | | |
|---|---|---|---|---|
| 2,049,228 | A * | 7/1936 | Sebell | 220/281 |
| 3,142,409 | A * | 7/1964 | Ross | 220/281 |
| 3,380,610 | A | 4/1968 | Krieps | |
| 3,381,872 | A * | 5/1968 | Holder et al. | 220/203.09 |
| 3,484,016 | A * | 12/1969 | Turner | 220/281 |
| 3,679,088 | A | 7/1972 | Swett et al. | |
| 3,692,208 | A | 9/1972 | Croyle et al. | |
| 3,743,131 | A | 7/1973 | Croyle et al. | |
| 3,799,388 | A | 3/1974 | Knize | |
| 3,895,736 | A | 7/1975 | Swett | |
| 4,027,776 | A | 6/1977 | Douglas | |
| 4,117,950 | A | 10/1978 | Allen | |
| 4,215,797 | A | 8/1980 | Chen | |
| 4,426,014 | A | 1/1984 | Coltman, Jr. | |
| 4,471,880 | A | 9/1984 | Taylor et al. | |
| 4,574,974 | A | 3/1986 | Von Holdt | |
| 4,678,082 | A | 7/1987 | Fillmore | |
| 4,852,753 | A | 8/1989 | Ochs | |
| 5,186,344 | A | 2/1993 | Cook | |
| 5,356,026 | A | 10/1994 | Andress et al. | |
| 5,458,252 | A | 10/1995 | Logel | |
| 5,791,473 | A * | 8/1998 | Decker et al. | 206/407 |
| 5,855,288 | A * | 1/1999 | Dallas, Jr. | 215/228 |
| 5,894,953 | A * | 4/1999 | Ramirez | 220/785 |
| 6,068,154 | A | 5/2000 | Grabher | |
| 6,168,044 | B1 * | 1/2001 | Zettle et al. | 220/784 |
| 6,220,471 | B1 | 4/2001 | Lowry | |
| 6,364,152 | B1 | 4/2002 | Poslinski et al. | |
| 6,688,486 | B2 | 2/2004 | Diamond et al. | |

(Continued)

FOREIGN PATENT DOCUMENTS

| | | |
|---|---|---|
| EP | 1 236 653 | 2/2001 |
| EP | 1 197 439 | 7/2001 |

*Primary Examiner* — Anthony Stashick
*Assistant Examiner* — Jeffrey Allen
(74) *Attorney, Agent, or Firm* — Stites & Harbison PLLC; Marvin Petry

(57) ABSTRACT

A overcap is provided which covers the opening of a container. The overcap, in one form, engages an exterior of the container around the rim and along an inwardly directed flange which defines an opening of the container. The overcap snappingly engages with the container to produce an audible indication that the overcap is firmly attached to the container and that air is being expelled from inside the container. In another form, the overcap includes an invertible dome which is transformable between an upward convex position and an upward concave position.

11 Claims, 9 Drawing Sheets

U.S. PATENT DOCUMENTS

2002/0148845 A1* 10/2002 Zettle et al. ..... 220/781
2002/0175173 A1 11/2002 Diesterbeck
2003/0010787 A1 1/2003 Dalton et al.
2004/0094553 A1 5/2004 Crider et al.
2004/0137110 A1 7/2004 Dalton et al.
2004/0195138 A1* 10/2004 van Holdt, Jr. ..... 206/508
2004/0206765 A1 10/2004 McMahon, III et al.
2004/0245261 A1* 12/2004 Stanos et al. ..... 220/793

* cited by examiner

SNAP RESEALING CLOSURE FOR A CONTAINER

FIELD OF THE INVENTION

The present invention relates to a closure for a container, and in particular, a snap resealing overcap for a container.

BACKGROUND OF THE INVENTION

Containers such as those for various food products, such as coffee, often comprise a sealed metal container. Traditionally, one would gain access to the contents of the container by using a can opener to remove the lid or top of the container. A separate plastic overcap has traditionally been attached to the container around the chime to cover the opening once the original lid or top had been removed. Conventionally, the overcap is a simple annular disc with a vertical skirt extending down and engaging a corresponding exterior surface of the chime of the container.

Recent developments in containers include replacing the traditional metal container top, which requires the use of a can opener to gain access to the contents within, with a flexible and/or peelable foil membrane which extends over the opening and allows a user to remove it by pulling back on a tab of the flexible or peelable membrane.

Further recent developments in containers include replacing a metal container with a plastic container, such as a container formed from polyethylene or polypropylene. These plastic containers typically include a peelable foil membrane over the opening as described above.

One recent overcap designed for engaging the top of a container is disclosed by U.S. Pat. No. 6,220,471 ('471). The '471 patent shows an overcap with an outer skirt which seals inwardly against the rim of the container. A flexible ring of the overcap has a leading edge which extends downwardly to engage a peripheral bead on the inside edge of a horizontal flange of the container. Movement of the leading edge past the bead results in a snap closure action which is accomplished by pressing on the center of the overcap.

U.S. Pat. No. 3,380,610 discloses a flexible closure for the neck of a container in which an annular sealing member of the closure hingedly connects an inner portion thereof to the rest of closure. The sealing member includes a portion which extends radially outward from the inner portion to snugly engage an inside surface of the container neck.

U.S. Patent Application Publication No. 2003/0010787 discloses an overcap having a dome portion which can be used to accommodate pressure build-up in the container and subsequently to "burp" the container during use of the overcap, although the method of "burping" is not disclosed. The overcap seals along two lines of the container, namely along an inward extending flange of the container and, with its skirt, along an outer rim of the container.

There exists a need in the art for an improved overcap for use with a container of the type described.

SUMMARY OF THE INVENTION

The present invention concerns a new and improved overcap for a container.

In a preferred arrangement the overcap includes a dome which is in an upward convex position, as viewed looking down from above, as originally applied to the container and upon a downward force applied to the dome is displaced inwardly to transform the dome to an upward concave position. Preferably the overcap snappingly engages with the container during the downward movement to produce an audible indication that the overcap has tightly engaged with the container.

One advantageous feature of this overcap is that it expels air present inside the container during such downward movement. Preferably, the expelling air produces an audible "swoosh" sound to indicate to consumers that air is expelled, a good seal is formed, and freshness is "sealed-in."

A second advantageous feature of this overcap is that it produces a better, tighter seal when the overcap is affixed to a container and transformed to its concave position.

The present invention, in one form thereof, relates to a closure individually or in combination with a container, comprising an overcap having a skirt with an inwardly facing surface engageable with the exterior of a container and an invertible dome which is transformable between a convex position and a concave position. The dome expels air from inside the container when transformed from the convex position to the concave position, and the dome maintains its concave position after transformation. The overcap preferably produces an audible noise upon inversion of the overcap.

In one form, the inwardly facing surface of the overcap is engageable with the exterior of a container along at least two lines, and advantageously, at along at least three lines.

In another form, the overcap forms a tighter seal with the container when in the concave position as compared with the convex position.

In yet another form, the overcap is transformed from the convex position to the concave position in a single action by applying force to the invertible dome with one hand.

The present invention, in one form thereof, relates to a closure, individually or in combination with a container in which the closure includes an overcap having an outer wall with an inwardly facing surface which engages with the exterior of the container and an inner wall with an outwardly facing surface having a plurality of pairs of convex projections extending radially outwardly towards the outer wall. The convex projections include an upper projection and a lower projection. Each of the pair of projections is adapted to permit a flange of the container extending radially inwardly from the periphery of the container to be disposed between the upper projections and the lower projections.

In one form, the overcap has an invertible dome which is transformable between a convex position and a concave position.

In various further alternative forms, (1) a V-shaped portion is disposed between an outer ring projection and an inner ring projection and the V-shaped portion forms a hinge between the outer ring projection and the inner ring projection; (2) the V-shaped portion includes a bottom bridge which engages a top surface of the flange of the container; and (3) a plurality of vent channels are located on an inward side of the dome and extend radially to a location between each pair of upper and lower projections.

The present invention, in yet another form thereof, relates to a closure individually or in combination with a container in which the closure comprises an overcap having an outer ring projection and an inner ring projection. The outer ring projection engages the exterior of the container and the inner ring projection engages the flange of the container which extends radially inwardly from the outer periphery of the container towards a top opening of the container. The overcap has an invertible dome which is transformable between a convex position and a concave position. A V-shaped portion between the outer ring projection and the inner ring projection forms a hinge between the outer ring projection and the inner ring projection.

The present invention, in another form thereof, relates to a closure individually or in combination with a container in which the closure comprises a snap overcap having an inwardly facing surface engageable with the exterior of a container and an invertible dome which is transformable between a convex position and a concave position. The dome maintains its concave position after transformation. The overcap preferably produces an audible indication that the overcap is securely affixed to the container.

The present invention, in yet another form thereof, relates to a closure individually or in combination with a container in which the closure includes an overcap having an outer ring projection and an inner ring projection and a plurality of vent channels located along an inward side of the overcap and extending radially from a center portion of the overcap to the inner ring projection.

The present invention, in another form thereof, relates to a closure individually or in combination with a container in which the closure comprises an overcap having an outer ring projection and an inner ring projection for placement over an opening of a first container. The outer ring projection has a circumference shaped to engage a bottom rim of a second container to thereby permit the first container to be stacked on the second container.

The present invention in yet another form thereof, relates to a package with an overcap comprising a container with a bottom rim and an overcap having an outer ring projection and an inner ring projection for placement over an opening in a first container. The outer ring projection has a circumference to engage with a bottom rim of the second container.

The present invention, in another form thereof, relates to a package with an overcap comprising a container having interior sides, a bottom, and an opening at the top; and an overcap having a skirt with an inwardly facing surface engageable with the exterior of the container, the overcap having an invertible dome which is transformable between an upward convex position and a concave position, wherein the overcap forms a tighter seal with the container when in the concave position as compared with the convex position.

BRIEF DESCRIPTION OF THE FIGURES

Further characteristics and advantages of the invention will be revealed more fully in the following detailed description, provided by way of example and without restrictive intent, with reference to the attached drawings, in which.

DETAILED DESCRIPTION

Referring now to the Figures, like numbers represent like elements among the several views.

Referring to FIGS. 1-6, overcap 10 is placed on top of a container 50 which packages a product 60, for example, ground roast coffee. In addition, the product can be other food items, such as peanuts, and the container can be in the form of a cylinder. The container could be made of metal or any other suitable material including plastics such as polyethylene and polypropylene, and can have any shape or size appropriate to package the desired product.

Figure 1:
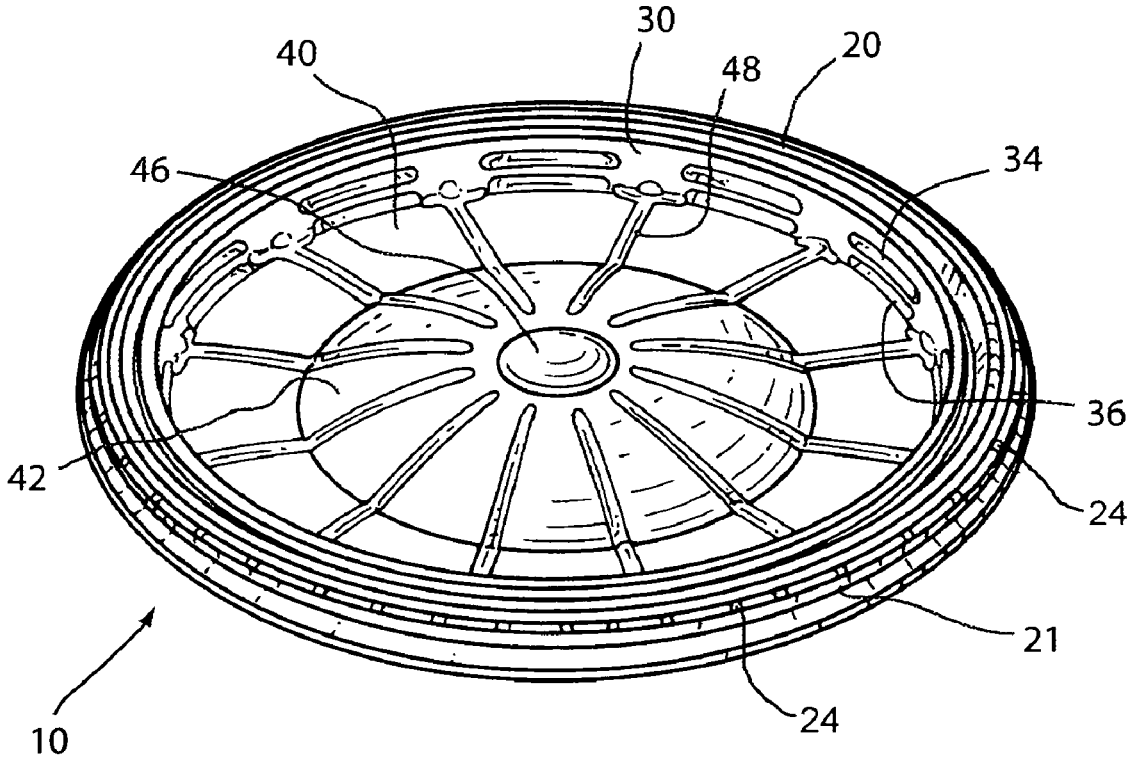
FIG. 1 is an upper perspective view of an overcap in accordance with the present invention.
Figure 2:
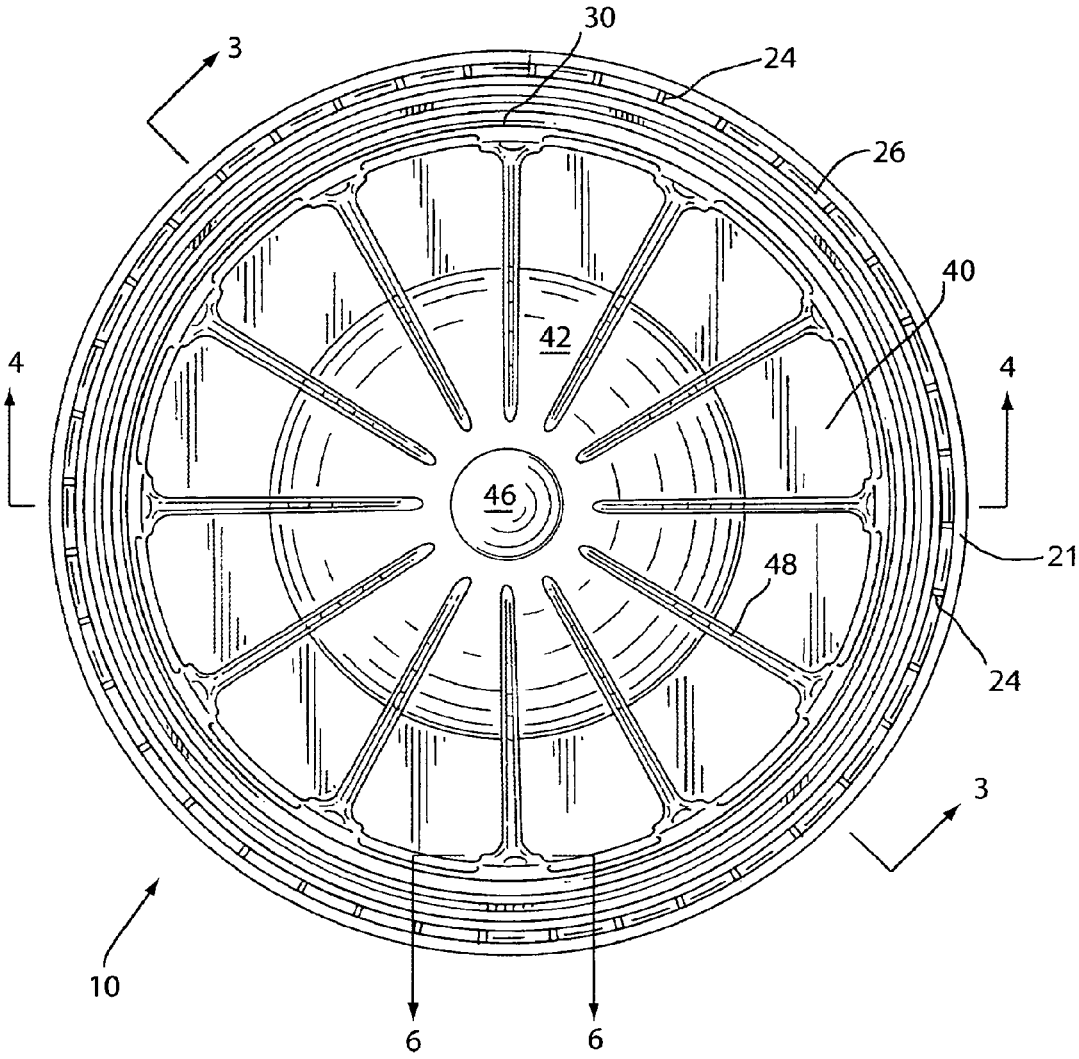
FIG. 2 is a plan view of the overcap of FIG. 1.
Figure 3:
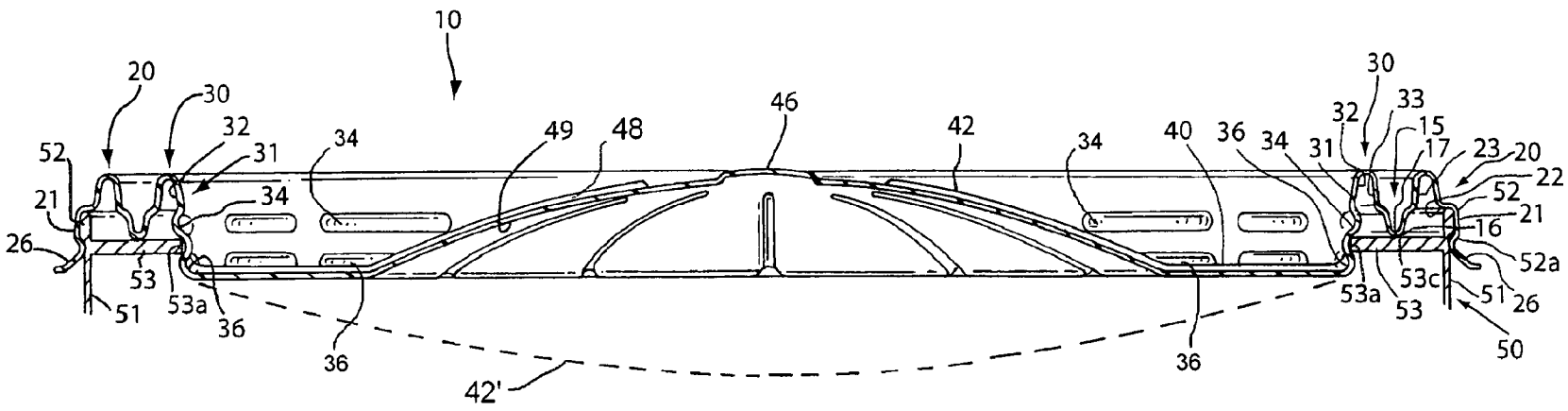
FIG. 3 is a cross-sectional view of the overcap, taken along line 3-3 of FIG. 2 together with the upper portion of a container on which it is mounted.
Figure 4:
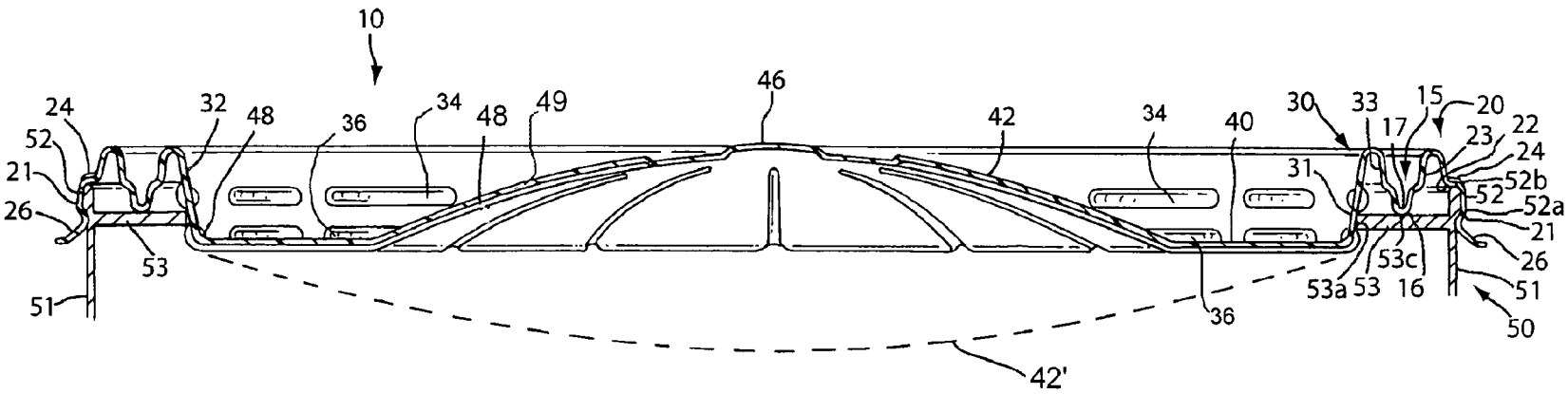
FIG. 4 is a cross-sectional view of the overcap, taken along line 44 of FIG. 2 together with the upper portion of a container on which it is mounted.
Figure 5:
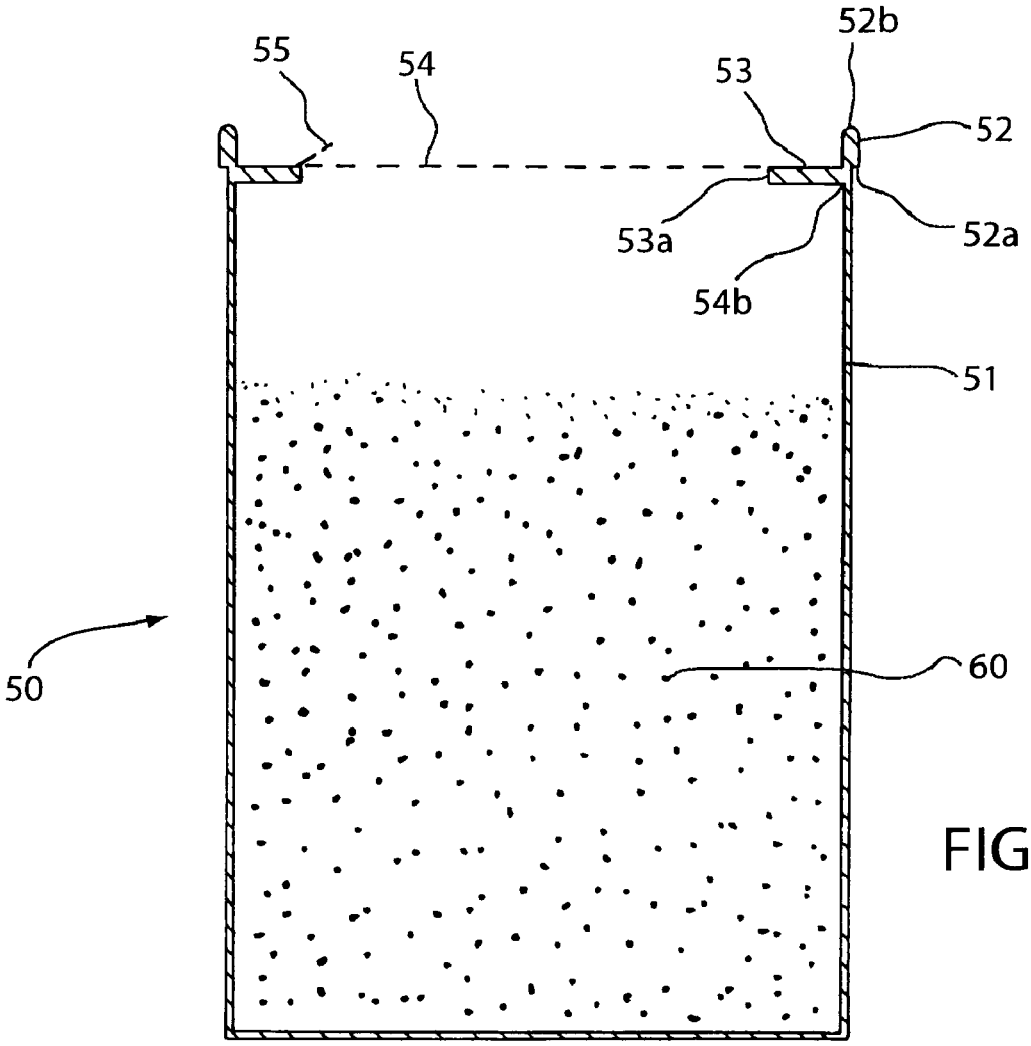
FIG. 5 is a cross sectional view of a container with which the overcap of the present invention is used, the upper portion of which is shown in FIGS. 3 and 4.

Referring to FIG. 5, the top of the container 50 is sealed by a flexible peel-off membrane 54 formed of a flexible foil material, which membrane is hermetically sealed around its periphery to a ledge in the form of flange 53 which is integral with the container 50. Container 50 includes sides 51, a chime 52 and the flange 53 which defines a top opening in the container when the peel-off membrane 54 has been removed. In a manner known per se, the easy peel-off membrane 54 has a pull tab 55.

Figure 6:
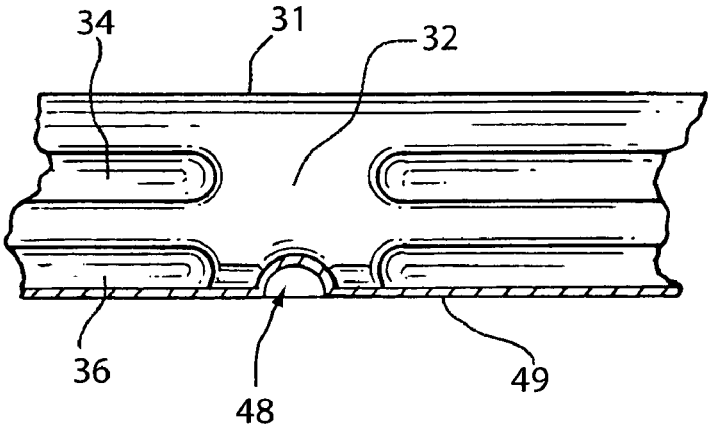
FIG. 6 is a partial sectional view of the overcap taken along line 6-6 of FIG. 2.

The overcap 10 is composed of resilient material such as polypropylene or other suitable material. Referring to FIGS. 1-4 and 6, but in particular to FIGS. 3 and 4, it attaches at two radially spaced peripheral locations of the container 50 to be disposed over the membrane 54 and to seal the opening of the container 50 after membrane 54 has been removed. One attachment is where outer ring projection 20 resiliently engages an exterior surface 52*a* of chime 52 along inwardly facing surface 22 of outer wall 21. The other attachment is where an inner ring projection 30 contacts the flange 53 at flange surface 53*a*. As best shown in FIG. 6, an inner wall 31 has an inwardly facing wall surface 32 with a series of pairs of radially upward convex projections in the form of upper projections 34 and lower projections 36. When overcap 10 is disposed on container 50, the upper projections 34 and lower projections 36 straddle flange 53 with inwardly facing wall surface 32 adjacent flange surface 53*a*.

Between outer ring projection 20 and inner ring projection 30 is a V-shaped portion 15 with bottom surface 16 which abuts or is adjacent to flange surface 53*c* when overcap 10 is affixed to container 50. Advantageously, bottom surface 16 forms a seal with flange surface 53*c*. The bottom of the V-shaped portion 15 defines a bottom bridge which forms a hinge 17 between the inner ring projection 20 and the outer ring projection 30, with the two legs of the V-shaped portion 15 formed by inner wall 23 of outer ring projection 20 and outer wall 33 of inner ring projection 30. The combination of the resilient material comprising overcap 10 and the structure of the hinge 17 allow the inner wall 23 and the outer wall 33 of the V-shaped 15 portion to serve as arms of the hinge 17 between the outer ring projection 20 and the inner ring projection 30, to help achieve attachment of the overcap 10 on container 50.

It will be apparent to one skilled in the art that the overcap 10 contacts various surfaces of the container 50 at a number of contact points or lines. For example, inwardly facing wall surface 22 contacts chime surface 52*a*, outwardly facing wall surface 32 contacts flange surface 53*a*, and hinge 17 contacts flange surface 53*c*. The multiple contact points or lines ensures there is a tight fit between the overcap 10 and the container 50.

A series of convex projections or raised notches 24 are formed on an inwardly facing surface of outer ring projection 20 which abut top surface 52*b* of chime 52. The raised notches 24 provide small vent channels to vent gas up and over chime 52 and then down along a gap formed between inwardly facing surface 22 and chime 52.

An annular disc portion 40 extends substantially horizontally and radially inward from the inner ring projection 30 until about midway to the center of the overcap 10 at which location a dome 42 is formed. The dome 42 extends inward up to a further raised center portion 46. The thickness of the material forming the dome 42 is between ⅓ and ⅔ the thickness of the material forming the annular disc portion 40, and preferably ½ as thick.

The container 50 is shipped with dome 42 in a bowed upward convex position, as viewed looking down from above, with the center of the dome being about the same height as the top of the inner and outer ring projections 20 and 30. This position accommodates stacking of one container on top another container when the dome is in its convex position.

After purchase of the container with its overcap by a user and after removal of the membrane 54 and placement of the overcap 10 on the container 50 in its convex position, the dome 42 is transformable by pushing the dome center 46 until the dome inverts with the dome 42 substantially below the bottom of the remainder of the overcap 10, to form an upward concave position. Advantageously, the dome 42 is inverted by a person using the thumb or palm of a single hand, and preferably in a single action, using the thumb or palm to affix and/or seal the overcap to the container while inverting the dome. Further, when the dome is inverted, the overcap 10 produces an audible noise or "snapping" sound. In the inverted, concave position, the annular disc portion 40 is bent inward and downward somewhat as shown generally by broken line 42' in FIGS. 3 and 4. In addition, as the overcap is being inverted while over the opening of the container, an audible noise of a "swoosh" is produced as air is displaced from inside the container to the exterior environment. The audible noise may indicate to consumers that freshness of the food product will be preserved by a tight seal and the expulsion of air from inside the container.

As the dome is pushed inward while placed on the container over the opening, the dome 42 exerts radially outward pressure or force on inner ring projection 30 and, in particular, inner wall 31, which in turn applies a radially outward force on flange surface 53*a*, thereby forming a tighter seal between the overcap 10 and the container 50 when the overcap 42 is in the concave position.

A series of vent channels 48 are formed on inwardly facing surface 49 of dome 42 and annular disc portion 40, forming channels in the inwardly facing surfaces and forming a projection extending upward from the top surface of the dome 42 and annular disc portion 40. The vent channels 48 extend radially from the dome center 46 along dome 42 and annular disc portion 40, terminating between each of the circumferential disposed series of upper/lower projections 34, 36. The vent channels 48 provide a downstream venting path allowing for the release of gas pressure in the container 50, venting gas from the container 50 to the inner ring portion 30 of the overcap 10.

The overcap 10 may be placed on the container in either its convex or concave position. In either case, by moving the inner ring projection 30 and outer ring projection 20 onto the chime 52 of the container, the overcap will be tightly attached to the container as described above. But preferably, the user will place the overcap 10 onto the container in the convex position so that the user can invert the cap which expels air and provides an audible snap sound which further increases the tightness of the overcap on the container and/or provides the user with the perception/assurance that the overcap is tightly attached to the container, and a "swoosh" sounds as air is expelled from inside the container. As a result, the freshness of food product inside the container 50 is preserved by removing air from inside container 50.

For subsequent removal of the overcap, a portion of the outer ring 20 projection is easily pulled upward off of the outer projection 52*a* of the chime 52 which, in turn, moves an adjacent portion of the series of upper projections 34 and lower projections 36 up past the horizontal flange 53. The overcap is sufficiently flexible so that the remainder of the overcap is then easily pulled from the container 50.

It will now be apparent that the present overcap 10 provides advantages and features not found in prior overcaps. The series of upper and lower projections of the inner ring projection 30 straddle inwardly directed horizontal flange 53 of the container so as to effect a tight snap fit with audible indication that the overcap 10 is firmly attached to the container 50.

In addition, the V-shaped portion 15 serves as a hinge between the outer ring projection 20 and the inner ring projection 30 which enhances the attachment of the overcap 10 to the container 50 and in particular helps in directing the projection 36 over the flange 53. Further, the V-shaped portion engages a top surface 53*c* of the horizontal flange 53 to further effect the tightness formed between the overcap 10 and the container 50.

Further, the series of vent channels 48 located on the inward side of the dome 42 and annular disc 40 and raised projections 24 allow for gas to be vented from the inside of container 50 to the exterior environment.

Referring now to FIGS. 7*a*, 7*b*, 8*a* and 8*b*, container 150 is sealable with overcap 110. Overcap 110 has a dome 142, a V-shaped portion forming a valley 160 and a skirt 126. The dome 142 extends substantially across the diameter of the overcap 110 terminating at the valley 160. Valley 160 is defined by legs 162, 164 which form a pivotal hinge therebetween, forming the apex 166 of the valley 160. Like overcap 10, overcap 110 has an invertible dome 142 which has a convex position shown in FIGS. 7*a*, 8*a* and a concave inverted dome position 142', shown in FIGS. 7*b*, 8*b*. When the overcap 110 is in its inverted dome position 142', an outward facing surface 168 of leg 162 abuts flange surface 153*a* and inwardly facing overcap surface 116 abuts flange surface 153*c*. However, unlike overcap 10, overcap 110 does not have a series of vent channels formed on an inwardly facing surface of the dome 142, nor does the inward facing surface of overcap 110 have a series of convex projections or raised notches, or a series of pairs of radially upward convex projections 36 to straddle flange 153 of the container 150.

Figure 7A:
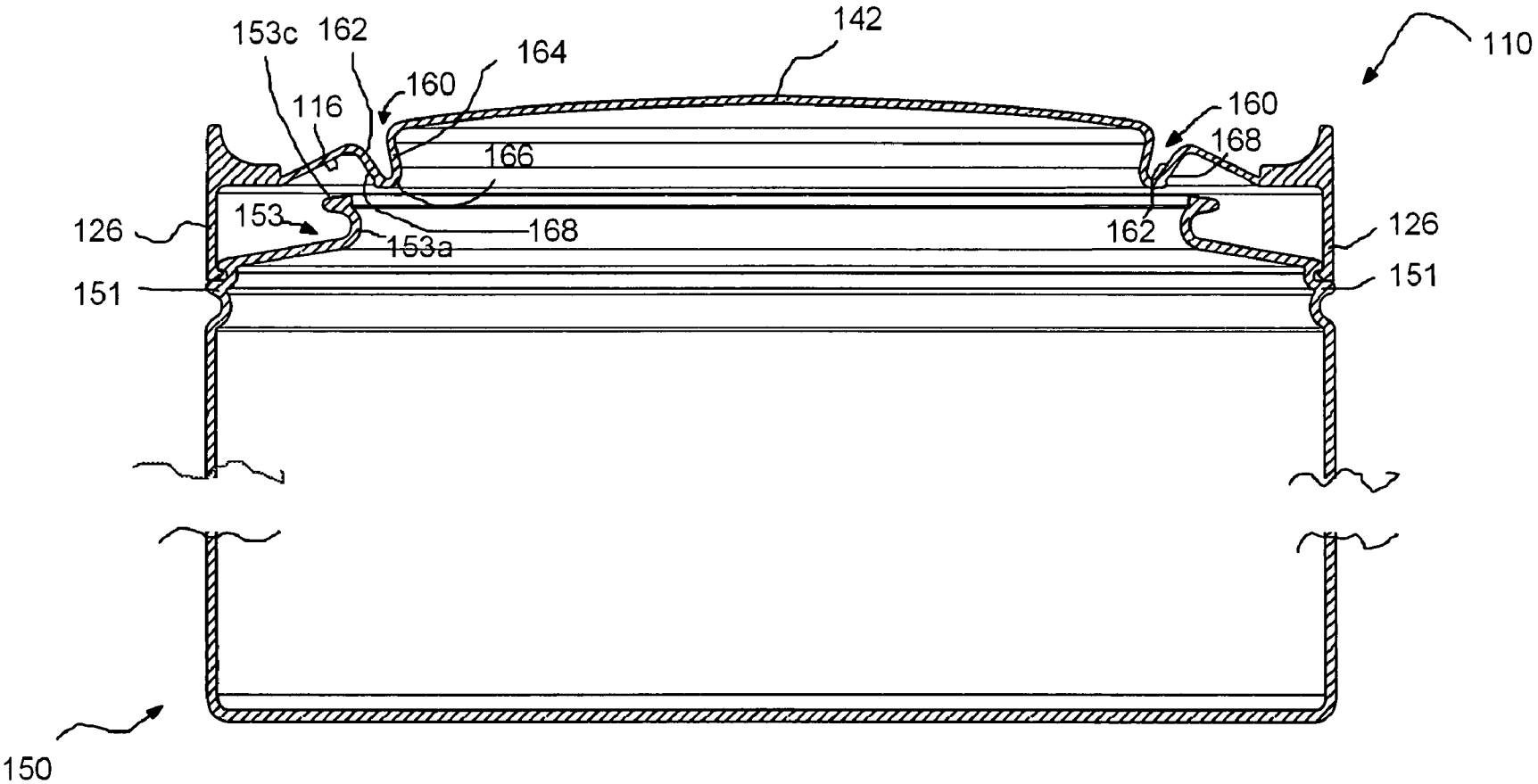
FIG. 7*a* is a cross-sectional view of an overcap and a container, shown with the overcap not completely sealed to the container and in its convex position, in accordance with another embodiment of the present invention.
Figure 7B:
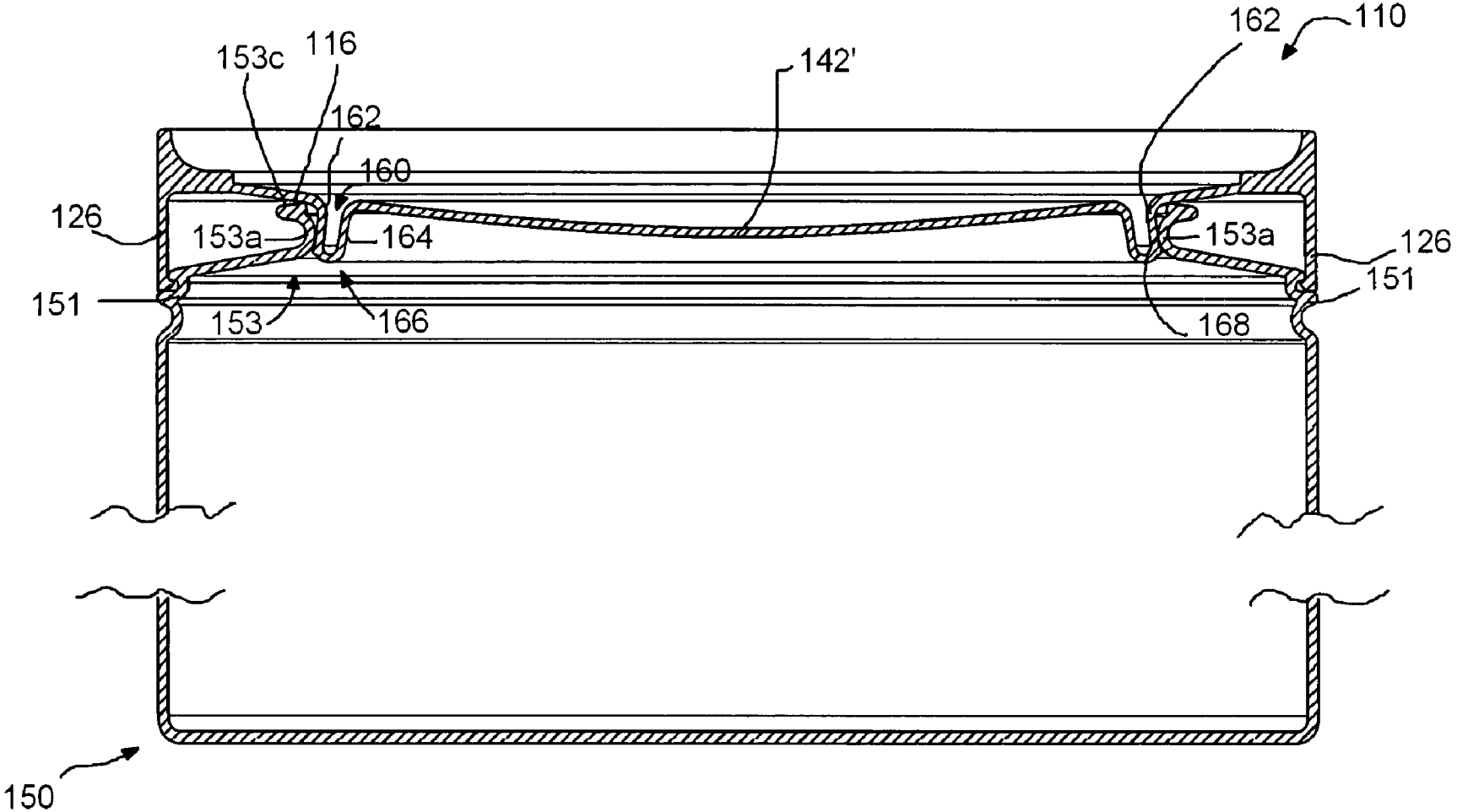
FIG. 7*b* is a cross-sectional view of the overcap and container of FIG. 7*a*, shown with the overcap completed sealed to the container and in its concave position.
Figure 8A:
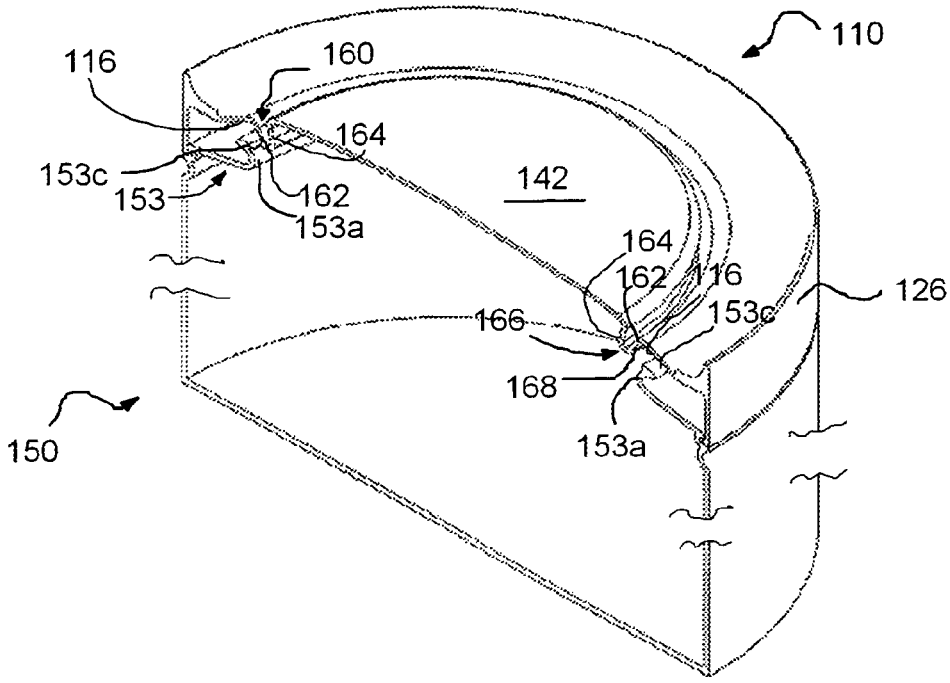
FIG. 8*a* and FIG. 8*b* are cross-sectional/perspective views of the overcap and container of FIGS. 7*a* and 7*b*, respectively.

To close container 150 using overcap 110, a user first loosely places the overcap 110 over the opening of the container, as depicted in FIGS. 7*a*, 8*a*, while the overcap 110 is in its convex position. When the overcap 110 is loosely placed on container 150, as shown in FIGS. 7*a*, 8*a*, the skirt 126 abuts and is in contact with container rim 151, but outward facing surface 168 of leg 162 is not in contact with flange surface 153*a* nor is overcap surface 116 in contact with flange surface 153*c*. To firmly seal overcap 110 to container 150, in a single action, a user applies a downward force to the top of dome 142 which pushes the overcap 110 inward towards container 150, transforming the dome 142 from its convex position to its concave position 142' depicted in FIGS. 7*b*, 8*b*, and thereby forcing air from inside container 150 to the exterior environment and producing a "swoosh" sound. Continued downward movement forces the outward facing surface 168 of leg 162 to be urged into contact with the flange surface 153*a* and overcap surface 116 into contact with flange surface 153*c*.

Figure 8B:
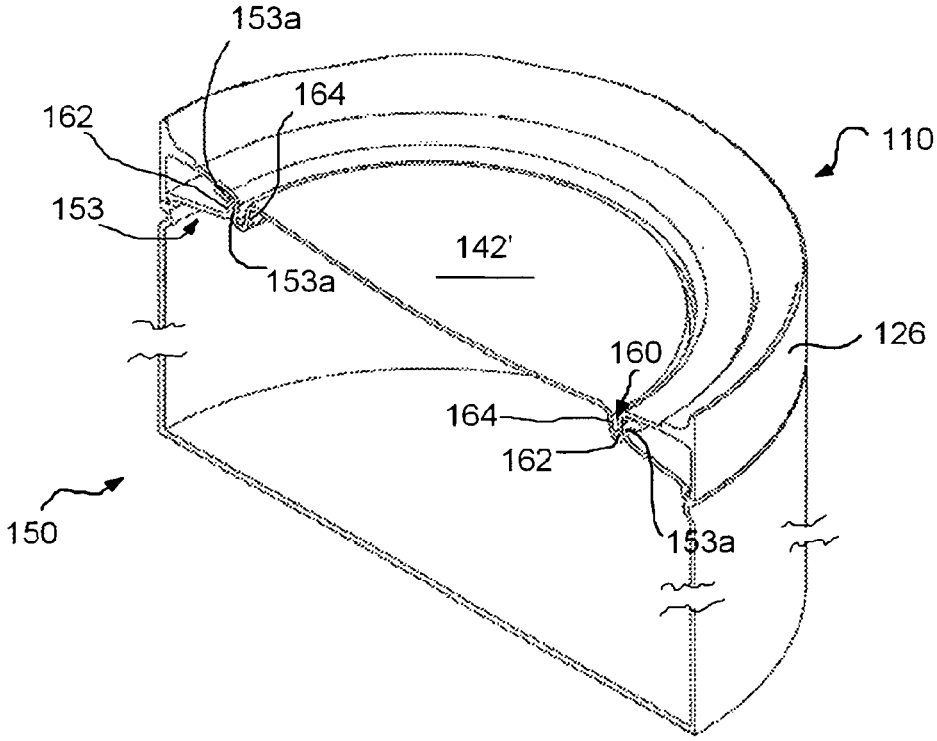

When in the concave position as shown in FIGS. 7*b*, 8*b*, the dome in its inverted concave position 142' exerts a radially outward force on leg 162 to provide a tight seal on flange surface 153*a*. As with overcap 10, pulling back on the skirt 126 allows one to remove overcap 110 from container 150 which preferably transforms the dome from its concave position 142' to its convex position 142.

Referring to FIGS. 9*a*-9*e*, overcap 210 seals container 250. Overcap 210, like overcaps 10 and 110, includes an invertible dome 242, a skirt 226 and a valley 260 formed therebetween. Like overcap 110, overcap 210 does not have radially extending vents or notches to vent air from inside the container 250 to the exterior environment.

Figure 9A:
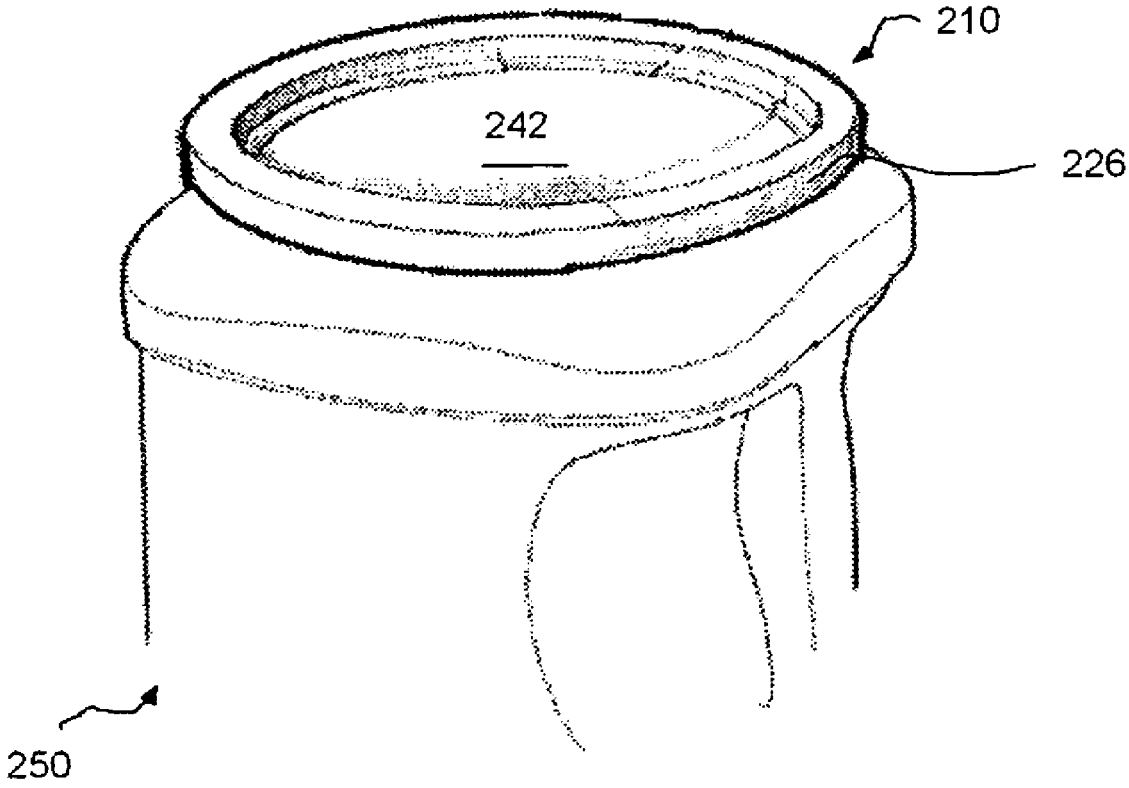
FIG. 9*a* is a partial perspective view of a container with overcap in its concave position, in accordance with another embodiment of the present invention.
Figure 9B:
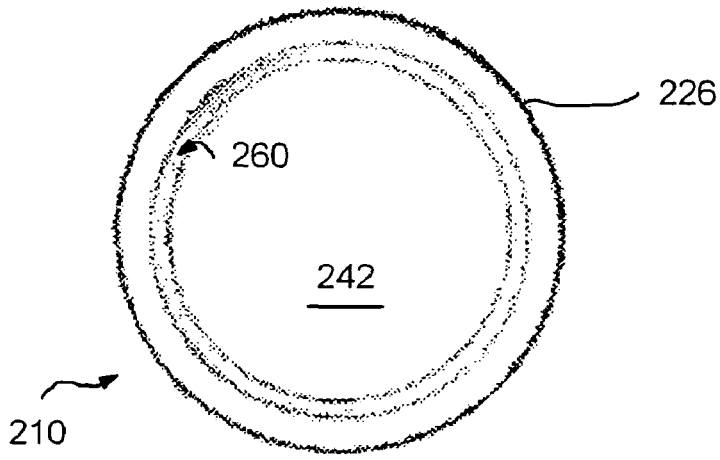
FIG. 9*b* is a plan view of the overcap of FIG. 9*a;*
Figure 9C:
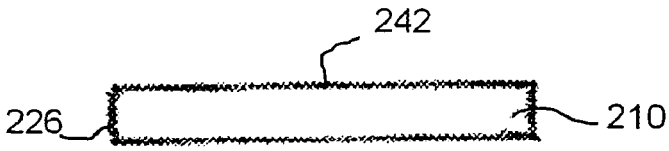
FIG. 9*c* is a side-elevational view of the overcap of FIG. 9*a*.
Figure 9D:
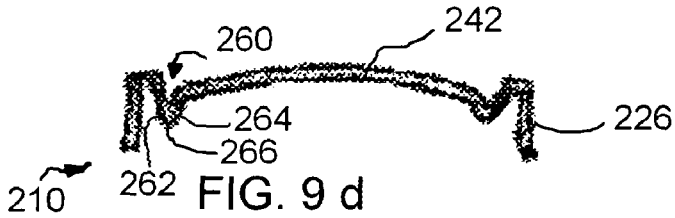
FIGS. 9*d* and 9*e* are schematic views showing the transformation of the overcap of FIG. 9*a* from its convex position to its concave position.
Figure 9E:
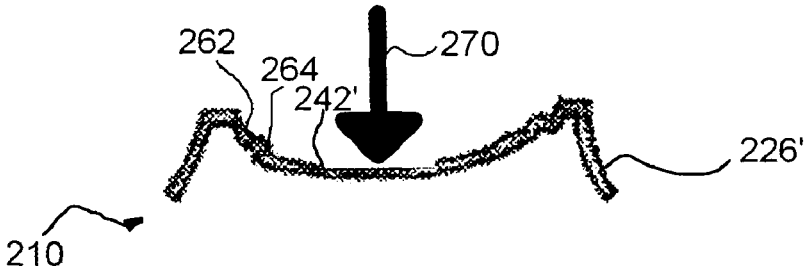

The invertible dome 242 comprises a central portion of the overcap 210, terminating at a valley 260 formed by legs 262, 264. The legs 262, 264 are pivotally connected to each other to form a hinge at an apex 266 of the valley 260. When the dome 242 is in its convex position, as shown in FIG. 9*d*, an angle formed between the legs 262, 264 is acute and smaller than the angle formed between the legs 262, 264 when the dome is in its concave position 242', as shown in FIG. 9*e*. When overcap 210 is transformed from its convex position (FIG. 9*d*) to its concave position 242' (FIG. 9*e*), the legs 262, 264 pivot relative to each other so as to increase the angle formed therebetween. In addition, when transformed to the concave position, skirt 226' is flared outward relative to skirt 226 when the overcap 210 is in its convex position.

As with overcap 10, 110, applying a downward force, indicated as arrow 270, transforms overcap 210 from its convex position (FIG. 9*d*) to its concave position 242' (FIG. 9*e*). Further, as with overcaps 10, 110, to seal container 250, the overcap 210 is first loosely placed over the opening of container 250 and subsequently pressing down on dome 242, in a single action, produces an audible sound as the overcap 210 engages the surfaces of container 250 to seal the container 250 and an audible "swoosh" sound as air is expelled from inside the container 250 to the exterior environment. Pulling back on the skirt 226' allows one to remove the overcap 210 from the container 250 which simultaneously transforms the overcap from its concave position to its convex position.

Although the invention has been described above in relation to preferred embodiments thereof, it will be understood by those skilled in the art that variations and modifications can be effected in these preferred embodiments without departing from the scope and spirit of the invention.

The invention claimed is:

1. A package with an overcap, said package comprising:

a container having interior sides, a bottom and an opening at the top; and an overcap having a downwardly extending skirt with an inwardly facing surface engageable with the exterior outwardly facing surface of a container, and said overcap having an invertible dome which is transformable between an upward convex position and an upward concave position and engages the container more tightly in the upward concave position than in the upward convex position and engages the container more tightly in the upward concave position than in the upward convex position, wherein, in the upward convex position, the dome has a convex central portion with a dome center, the dome including vent channels formed into the bottom surface of the overcap extending from the dome center along the dome to the outer periphery of the overcap, which channels guide air therealong and out through the outer periphery of the overcap when the overcap is transformed from its upward concave position to its upward convex position.

2. The package of claim 1, wherein said overcap is transformable to the upward concave position in a single action by applying a downward force to the invertible dome.

3. The package of claim 1, wherein said overcap produces an audible sound when transformed to the upward concave position.

4. The package of claim 2, wherein said overcap has an upright V-shaped portion with an apex pointing in the same downwardly extending direction as the skirt, located radially between the invertible dome and the skirt, and said container comprises a flange extending radially inward from the opening, and the apex of the V-shaped portion engages the flange.

5. The package of claim 4, wherein the flange also includes a substantially vertical portion extending above the radially inwardly extending flange portion, and wherein an inwardly facing portion of the overcap spaced radially outward from the V-shaped portion abuts the substantially vertical portion of the flange.

6. A package with an overcap, said package comprising:

a container having sides, a bottom and an opening at the top, the container having a flange extending horizontally radially inwardly from the sides and a vertical portion extending upwardly along an outwardly facing, exterior surface of the container; and an overcap having a downwardly extending skirt with an inwardly facing surface which engages the outwardly facing exterior surface of the vertical portion and a radially inner wall with an inner surface having a plurality of pairs of outward convex projections, the pair of outward convex projections comprising an upper projection and a lower projection, the horizontally extending flange of the container disposed between said projections, the overcap having an invertible dome which is transformable between an upward convex position and an upward concave position, the horizontal flange engaging the inner wall between the projections when the overcap is in its upwardly concave position the package further comprising a plurality of vent channels formed into an inwardly facing side of the dome and extending radially from a central portion of the overcap to a location between a respective pair of upper and lower projections, and venting from the channels to a location outside of the inner wall to provide for gas flow from inside the container to the outside environment when the overcap is transformed from its upward convex position to its upward concave position.

7. The package of claim 6, further comprising a plurality of raised notches on an inwardly facing surface of the skirt, which inwardly facing surface engages the exterior of the container, thereby forming gaps between the inwardly facing surface of the skirt and the exterior of the container, in which the skirt is not in contact with the container.

8. The package of claim 6, further comprising an annular disc portion located between the inner wall and the dome.

9. A package with an overcap, said package comprising:

a container having interior sides, a bottom, and an opening at the top; and an overcap having a skirt extending downwardly relative to a main center portion of the overcap, the skirt having a downwardly extending, inwardly facing surface engageable with an outwardly facing exterior surface of the container, said overcap having an invertible dome which is transformable between an upward convex position and an upward concave position, said overcap having a V-shaped portion with an apex pointing in the same downwardly extending direction as the skirt, the V-shaped portion located radially between the invertible dome and the skirt, said container comprising a flange extending radially horizontally inward from the opening, and the apex of the V-shaped portion abutting a surface of the flange, and wherein the V-shaped portion is formed from two legs pivotally connected at an angle which forms the apex of the V-shaped portion, wherein, an angle between the two legs is greater when the overcap is in the upward concave position than when the overcap is in the upward convex position.

10. The package of claim 9, wherein the flange has a substantially vertical portion, and wherein an inwardly facing portion of the overcap spaced radially outward from the V-shaped portion abuts a top surface of the said vertical portion of the flange.

11. The package of claim 9, wherein the overcap forms a tighter seal with the container when in the upward concave position as when it is in an upward convex position.

* * * * *

UNITED STATES PATENT AND TRADEMARK OFFICE

CERTIFICATE OF CORRECTION

PATENT NO. : 8,403,174 B2
APPLICATION NO. : 11/510717
DATED : March 26, 2013
INVENTOR(S) : Blake et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 849 days.

Signed and Sealed this
Twenty-fifth Day of November, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,403,174 B2
APPLICATION NO. : 11/510717
DATED : March 26, 2013
INVENTOR(S) : Blake It is certified that error appears in the above-identified patent and that said Letters Patent is hereby corrected as shown below:

Title Page

(73) Assignee: "Kraft Foods Global Brands LLC," to --Kraft Foods Group Brands LLC--

Signed and Sealed this
Seventeenth Day of November, 2015

Michelle K. Lee

Michelle K. Lee
*Director of the United States Patent and Trademark Office*